United States Patent [19]

Franck et al.

[11] 4,451,085

[45] May 29, 1984

[54] CHAIR

[75] Inventors: Klaus Franck, Hanover; Werner Sauer, Wennigsen, both of Fed. Rep. of Germany

[73] Assignee: Wilkhahn & Hahne GmbH & Company, Fed. Rep. of Germany

[21] Appl. No.: 244,679

[22] Filed: Mar. 17, 1981

[30] Foreign Application Priority Data

Oct. 1, 1980 [DE] Fed. Rep. of Germany ..... 3036993

[51] Int. Cl.[3] ..... A47C 3/00

[52] U.S. Cl. ..... 297/285; 297/292; 297/300; 297/320; 297/457

[58] Field of Search ..... 297/301, 316, 292, 285, 297/320, 457, 300

[56] References Cited

U.S. PATENT DOCUMENTS

| | | | |
|---|---|---|---|
| 868,052 | 10/1907 | Wilmot | 297/320 |
| 2,365,200 | 12/1944 | Lorenz | 297/292 |
| 3,133,765 | 5/1964 | Kramer | 297/457 |
| 3,140,118 | 7/1964 | Dorn | 297/285 |
| 3,146,028 | 8/1964 | Grosfillex | 297/457 |
| 3,387,887 | 6/1968 | Jakobsen | 297/457 |
| 3,874,727 | 4/1975 | Mehnert | 297/320 |
| 4,270,797 | 6/1981 | Brauning | 297/316 |

FOREIGN PATENT DOCUMENTS

| | | | |
|---|---|---|---|
| 110887 | 7/1940 | Australia | 297/316 |

*Primary Examiner*—Francis K. Zugel

*Attorney, Agent, or Firm*—Antonelli, Terry & Wands

[57] ABSTRACT

A reclining article of furniture for sitting, especially an office chair, with the article including a seat portion and a back portion articulated thereto. The seat portion and back portion are respectively connected to an underframe. The seat portion is supported in a forward zone and the back portion is supported by a supporting lever articulated to the underframe and articulated to the back portion at hip level of a user. To obtain a support which is also effective in the zone of the lumbodorsal vertebrae and to provide a close contact of the supporting surfaces with the users body. The contact is uniform in the rest position approximately from a back of the knees up to the shoulder blades. The seat and back merge through an arcuate intermediate section which is flexible so that the arc becomes wider. A connecting line extending between two points of articulation of the supporting lever in a basic position of the chair is inclined at an angle of between 0° and 25° and, preferably, between 15° and 25°, with respect to the vertical. By virtue of these features, the seat surface is initially lengthened toward a rear before a stronger rearward inclination of the back occurs when the seat is moved from an upright sitting attitude to a reclined attitude.

32 Claims, 13 Drawing Figures

7
P'
9
6
2
1
3
S
R
β
γ
β

7
11
P
8
10
9
X
Y
P'
6
5
5'
4
α
V
R
T
2
1
3
3'
S
13

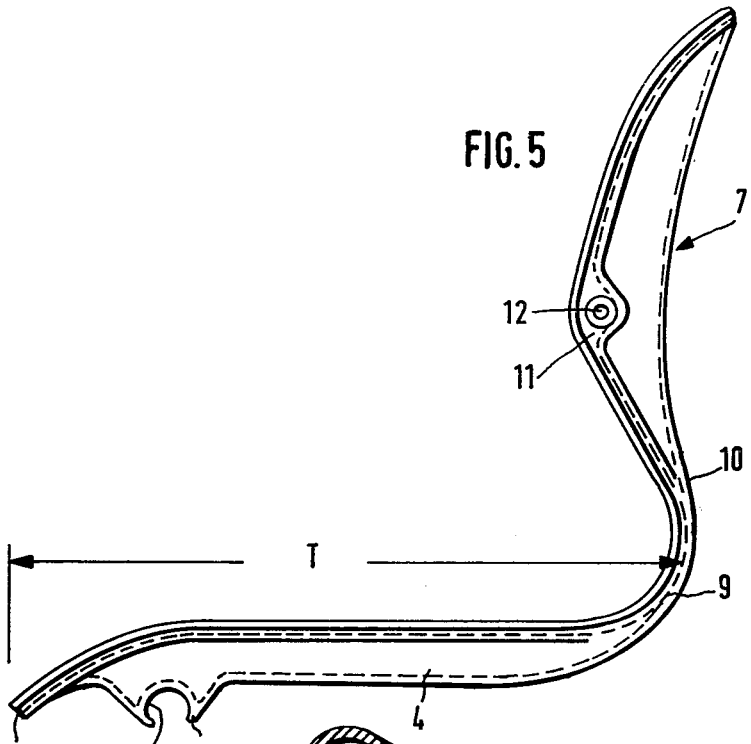
FIG. 5
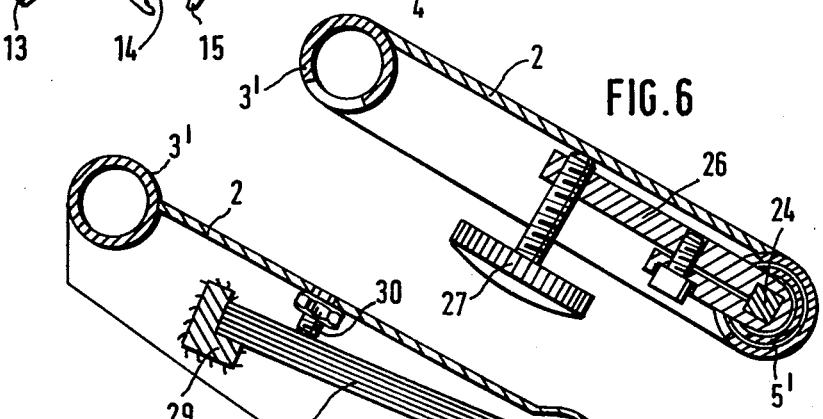
FIG. 6
FIG. 7

CHAIR

The present invention relates to a chair construction and, more particularly, to a so-called office chair, which includes a back portion articulated to a seat portion and an underframe on which the seat is supported in a forward zone by way of a joint, with the back portion being supported by a supporting lever articulated at hip level, wherein the supporting lever is articulated approximately below a center of the seat portion at the underframe. There have been various proposals for seat construction wherein a seat inclination and a back inclination can be varied at specific mutual ratios. In these proposed chairs, in an unstressed or uninclined position, the chairs have an angle of 90° between the seat portion and back portion as viewed along a generally horizontal extension of the seat portion with such angle being retained as long as the user, in a working position, stresses essentially only on the surface of the seat portion. If the user attempts to lean backwards into a rest position, the seat surface in the proposed articles of sitting furniture generally, only after releasing a locking mechanism, is slightly inclined downwardly by a minor angle at the rear end and the back is pivoted rearwardly by an angle which is two to three times as large wherein, for a rest position, angles of up to 130° are provided between the seat surface and back surface.

While the above-proposed pieces of sitting furniture with a so-called "synchronous" seat and back adjustment are certainly adequate for providing an ergonomically rather favorable adaptation of the surface of the sitting furniture to the respective body attitude of the user, this holds true only to a limited extent with respect to a zone of the lower lumbodorsal vertebrae if, for example, the seat is constructed in accordance with an arrangement proposed in Offenlegungsschrift 2,332,596 wherein a rearward seat edge is articulated directly or by way of a low bearing block to the adjoining back portion.

It has also been proposed in, for example, German Utility Models Nos. 7,721,954 and 7,815,561, to subdivide the surface of the seating portion into a forward partial surface and into a rearward partial surface hingedly joined to the forward partial surface. While in these proposed constructions three body supporting surfaces, that is, the forward partial surface, rearward partial surface, and back portion, are variable in their inclination, in these constructions the adapation to the respective body attitude can only be achieved by considerably increasing the overall constructional costs.

The aim underlying the present invention essentially resides in providing an article of sitting furniture for, for example, working purposes, having a synchronous seat and back adjustment which avoids the utilization of an expensive adjusting mechanism yet ensures a support effective also in a zone of the lumbodorsal vertebrae and affords, in a rest position, a hugging of the user's body by the supporting surfaces which is uniform approximately from the back of the knees to the shoulder blades.

In accordance with advantageous features of the present invention, the seat portion and back portion merge by an arcuate intermediate section which may be opened wider by flexing. A connecting line extending between two points of articulation of a supporting lever in the basic position is inclined in an angular range of between 0° and 25° and is preferably between 15° and 25° with respect to the vertical.

By virtue of the steep positioning of the supporting lever in the basic position, an advantageous feature results in that when changing over from an upright working attitude into a reclined attitude the back portion is initially moved considerably more strongly in a horizontal direction rearwardly and downwardly thereby affording, in conjunction with the thus widening and quasi-unfolding intermediate section between the seat portion and back portion, a uniform and large area support for the entire body during a transistion into the rest position.

Additionally, by virtue of the initial preferential rearward movement of the back portion as contrasted to a downward movement of the back portion as provided by the features of the present invention, the anatomy of the human body is taken into account in that when changing into a resting attitude, the upper part of the body does not only pivot rearwardly such as a lever about a pivot joint, but rather the body simultaneously unwinds somewhat in a rearward direction through the ischial tuberosities, and the upper part of the body also collapses somewhat in total with rearward movement of at least the lower lumbodorsal vertebrae. Thus, what is provided by the present invention, is an article of sitting furniture which is adapted to these body movements and constitutes a comfortable support which hugs the body very closely.

Preferably, in accordance with the present invention, the back portion may be curved convexly with respect to the seat portion, as viewed in a longitudinal cross section, and a lower half of the back may be inclined forwardly in the basic position of the chair so as to result in a very good support for the lumbodorsal vertebrae and the small of the back during an upright sitting attitude wherein the lower portion of the spine is likewise inclined somewhat in the forward direction.

When the chair of the present invention changes over through the vertical position into an inclined rest position, the seat portion executes a definite yielding movement toward the rear so that the hip of the user may roll along the seat and the spine may pass over into a more stretched and rearwardly inclined position.

In accordance with further features of the present invention, a spacing between the two points of articulation of the supporting lever is approximately twice as large as a spacing between a lower point of articulation of the supporting lever and a forward point of articulation of the seat, with these points of articulation defining, in a basic position, an acute triangle. By virtue of the disposition or arrangement of these points of articulation, a synchronized behavior of the seat portion and back portion inclinations result during the various sitting positions of the human body.

A significant advantage of providing the flexurally elastic section in accordance with the present invention renders the need for displacement joints, toggle levers, or similar expensive mechanisms superflous.

In accordance with still further features of the present invention, the provision can furthermore be made that the seat articulation point is located behind a front edge of the seat portion by about one-fourth of a depth of the seat portion, with a forward third of the seat being bent downwardly to a greater extent than the amount of upward pivoting of the front edge of the seat portion during a rearward pivoting of the article of sitting furniture. By virtue of these features, a favorable support and/or freedom is also ensured in a zone of the back of the knees in all sitting positions.

According to still further features of the present invention, a lower point of articulation of the supporting lever may be offset from a center of the seat portion toward a rear approximately by about ten percent of a depth of the seat portion so that, among other things, a significantly great stability against tipping of the chair is attained.

Moreover, according to the present invention, the back portion may be curved concavely with respect to the seat portion as viewed in cross section and may have a strongly forwardly curved bulge to support the small of the back of the user, with the upper point of articulation of the supporting lever being arranged at the forwardly curved bulge. By virtue of these features, not only is the supporting action directly improved but also a very steep position of the supporting levers is permitted without an impairment of the external appearance of the piece of sitting furniture.

Preferrably, the seat portion and back portion consist of a one piece shell formed of a synthetic resin. Advantageously, the shell may be provided at a front articulation point of the seat portion with semi-cylindrical bearings and with a snap rim or the like for receiving a horizontal bearing axle attached to an underframe of the chair.

As can readily be appreciated, the article of sitting furniture may also be manufactured not only as a chair but also as an arm chair provided with arm rests. For this purpose, arm rests of an elastic material may be provided which are attached to the piece of furniture at the points of articulation of the seat portion and the back portion, with the arm rests, if dimensioned appropriately, representing a sole source of the entire re-setting or re-storing spring force for the article of sitting furniture.

Instead of or in addition to providing a re-storing or re-bounding action by virtue of the provision of arm rests, it is also possible in accordance with the present invention, to provide an arrangement whereby the supporting lever is either directly or indirectly stressed by a re-storing or re-setting spring at a lower end of the supporting lever. The piece of sitting furniture may be provided with a device for adjusting a bias of the re-storing spring in order to be able to effect adaptation of the article of sitting furniture and size of the user.

It is also possible in accordance with the present invention, to equip the article of sitting furniture with a locking device for locking the supporting lever at least in a basic sitting position.

In accordance with the present invention, the re-storing or re-setting spring may take the form of either a torsion rod forming a lower articulation of the supporting lever, a coil spring, a leaf spring, or a pneumatic spring, with the springs acting on a cam or the like projecting radially from a lower bearing shaft.

It is also possible in accordance with the present invention, as an alternative to a one piece plastic shell, to provide an article of sitting furniture wherein the seat portion, and back portion respectively, are provided with separate frames which pass over or extend into each other by way of elastic connecting members.

Accordingly, it is an object of the present invention to provide an article of sitting furniture which avoids, by simple means, shortcomings and disadvantages encountered in the prior art.

Another object of the present invention resides in providing an article of sitting furniture which is simple in construction and therefore relatively inexpensive to manufacture.

Yet another object of the present invention resides in providing an article of sitting furniture which affords a uniform and large area of support for the entire body during a transion from an inclined to a rest position.

A further object of the present invention resides in providing an article of sitting furniture which provides a very good support for the lower lumbodorsal vertebrae and small of the back during an upright sitting on the article.

A still further object of the present invention resides in providing an article of sitting furniture which is readily adaptable to weight and size of a user.

These and other objects, features, and advantages of the present invention will become more apparent from the following description when taken in connection with the accompanying drawings which show, for the purposes of illustration only, several embodiments in accordance with the present invention, and wherein:

FIG. 5 is a side view of a seat and back shell of a piece of furniture constructed in accordance with the present invention;

FIG. 6 is a detailed cross sectional view, on an enlarged scale, of a re-storing spring constructed in accordance with the present invention for a piece of sitting furniture;

FIG. 7 is a detailed cross sectional view, on an enlarged scale, of another embodiment of a re-storing spring in accordance with the present invention;

Figure 2:
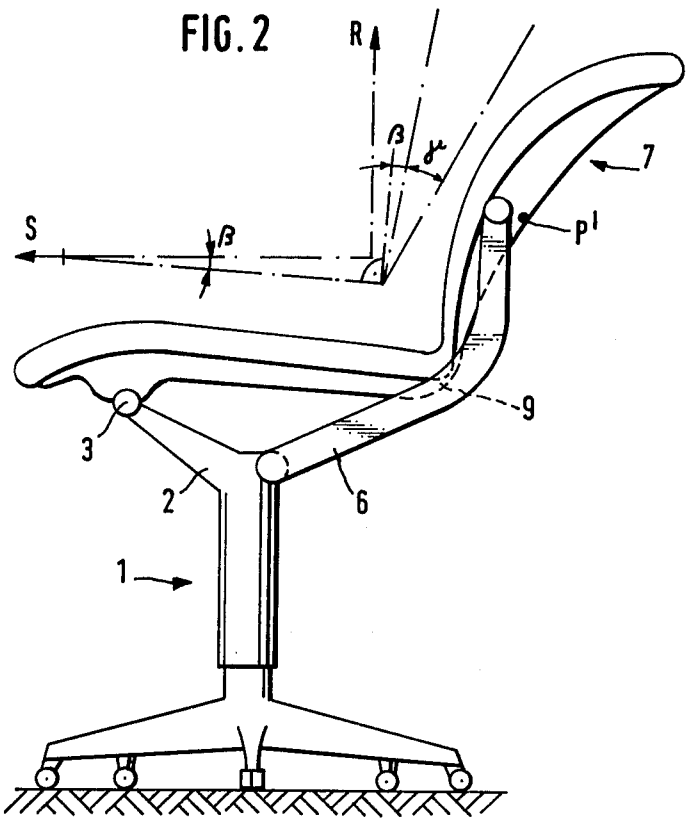
FIG. 2 is a side view of the office chair of FIG. 1 in a rearward-pivoted rest position.
Figure 1:
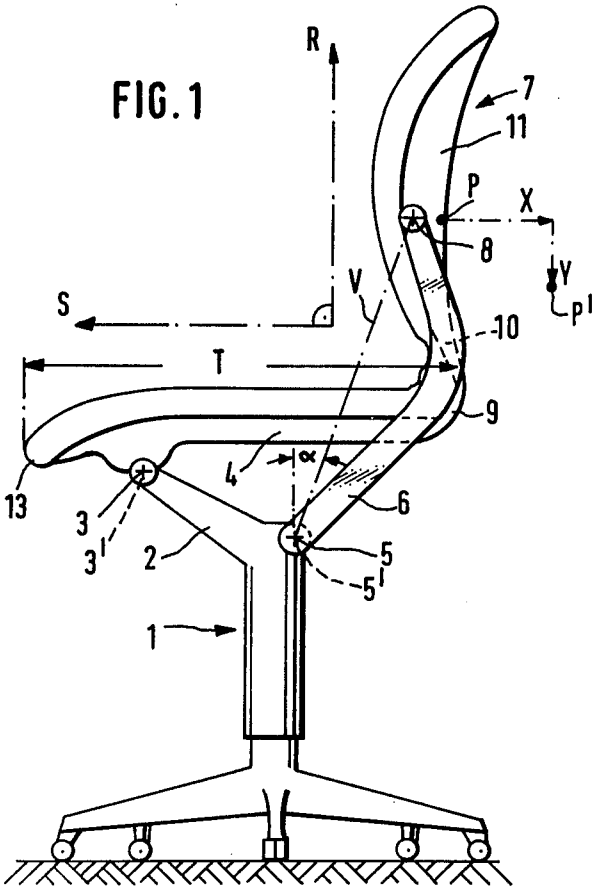
FIG. 1 is a side view of a first embodiment of a piece of sitting furniture constructed in accordance with the present invention fashioned as an office chair and in a basic position.

Referring now to the drawings wherein like reference numerals are used throughout the various views to designate like parts and, more particularly, to FIGS. 1 and 2, according to these figures, an article of sitting furniture such as, for example, an office chair, includes a column-type underframe generally designated by the reference numeral 1, from which projects a flat broad load bearing arm 2 extending obliquely upwardly in a forward direction at the upper end lying approximately below a center of the seat. A horizontal axle 3' is carried at a front end of the load bearing arm 2 and a seat portion 4 is articulated to the horizontal axle 3' at a forward or frontal zone thereof. A horizontal shaft 5' is supported at an upper end of the column-type underframe 1 in a position of about ten percent of a depth T of the seat portion 4 and offset toward a rear with respect to a center longitudinal axis of the column-type underframe 1. A supporting lever 6 is rigidly mounted on respective ends of shaft 5', with opposite ends of the respective supporting levers 6 being articulated, approximately at hip height, to a back portion generally designated by the reference numeral 7 of the piece of sitting furniture at an articulation point 8. The points of articulation 3, 5, and 8 form an acute triangle, with a connecting line V extending between the points of articulation 5 and 8 being about twice as long as a spacing between the points of articulation 3 and 5 at the column-type underframe 1. The connecting line V between the points of articulation 5 and 8 of the respective supporting levers is inclined by an angle $\alpha$ with respect to a vertical, with the angle $\alpha$ being about 20°. A stop means (not shown) is provided for fixing the chair toward the front in the basic position of FIG. 1.

In the embodiment of FIGS. 1 and 2, the seat portion 4 and back portion 7 consist of a shell of a synthetic resin manufactured in one piece and are connected to each other in a quasi articulated fashion by a central or intermediate section 9 which is almost planar in cross section. A radius of curvature of the flexible intermediate section 9 is, in the basic position, about 10 cm. The back portion 7 is curved convexly toward the seat portion 4, as viewed in a vertical longitudinal section, and a lower half 10 of the back portion 7 is inclined forwardly when the chair is in the basic position. Additionally, the back portion is curved concavely with respect to the seat portion 4 in a horizontal cross section and is provided with a strongly curved bulge 11 for supporting the small of the back. The upper points of articulation 8 for the two supporting levers 6 are arranged at the strongly curved bulge, with the points of articulation being formed, as shown most clearly in FIG. 5, as bearing eyes 12.

The front point of seat articulation 3 lies behind a front edge 13 of the seat portion 4 by about one-fourth of a depth T of the seat portion, with a forward third of the seat portion 4 being bent downwardly. As shown most clearly in FIG. 5, semi cylindrical bearings 14 provided with snap rims 15 are formed on the underside of the seat portion 4 and are adapted to receive the ends of the bearing axle 3'.

In the basic or working position of FIG. 1, the seat portion is essentially aligned with a horizontal plane and the back portion 7 is, on the average, aligned vertically as indicated by the phantom lines S and R in FIG. 1. During a backward or rearward reclining of the seat, the entire seat is pivoted, on the one hand, about its forward point of articulation 3 by a small angle $\beta$ in a downward direction but the relatively steeply oriented supporting lever 6 enforces upon the back additionally a pivoting movement toward the rear by an angle $\gamma$ during this reclining operation.

Figure 12:
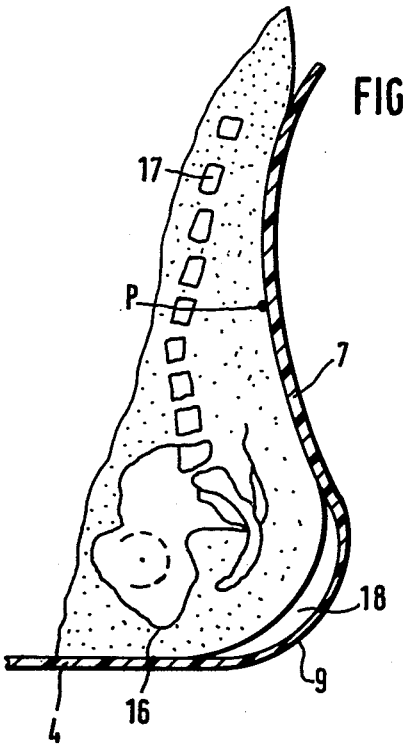
FIGS. 12 and 13 are partial sketches for illustration of body movements of the user of a chair of the present invention when changing from an upright sitting position to a reclining or rest position.
Figure 13:
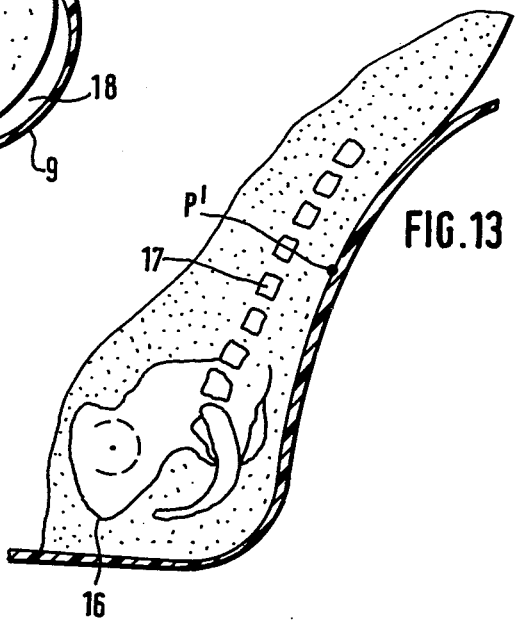

Considering for example a point P which, in the basic position of the chair, lies at hip level, during the reclining operation, the point P is displaced into the positon $P^1$ in the rest condition thereby executing a motion component X in a horizontal direction which is considerably larger than a motion component Y in the vertical direction. As shown most clearly in FIGS. 12 and 13, this execution by the point P corresponds to natural body movement during a transistion from an upright sitting position of FIG. 12 to a reclined sitting position of FIG. 13 since, besides a pivoting of the body of the user, there is also an unrolling movement through the ischial tuberosities 16, and the spine 17 stretches somewhat more extensively. The transistion zone between the seat portion 4 and the back portion 7 is, in the preferred embodiment, curved toward the rear to such an extent that, with an upright sitting attitude of the user, there usually remains a free space 18 (FIG. 12) which would be occupied by the pelvis when changing into the reclining position as shown in FIG. 13.

Figure 3:
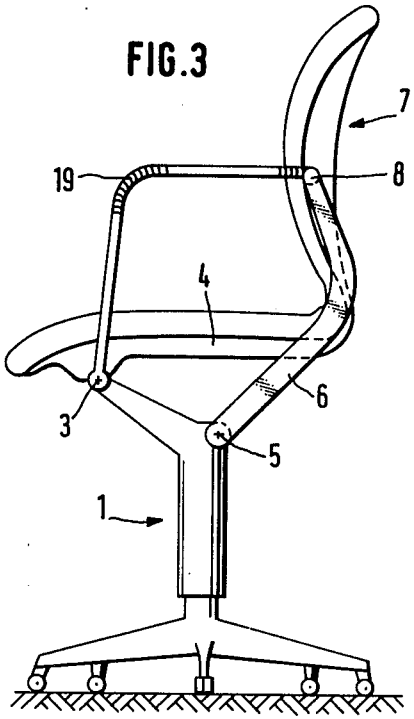
FIG. 3 is a second embodiment of a piece of sitting furniture constructed in accordance with the present invention and provided with elastic arm rests.
Figure 8:
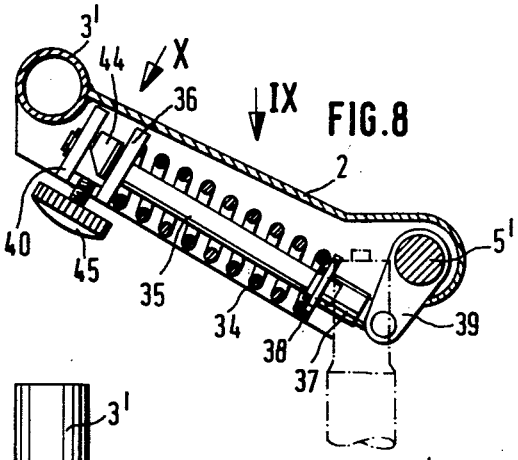
FIG. 8 is a detailed cross sectional view, on an enlarged scale, of a third embodiment of a re-bound spring mechanism for a piece of sitting furniture of the present invention.
Figure 9:
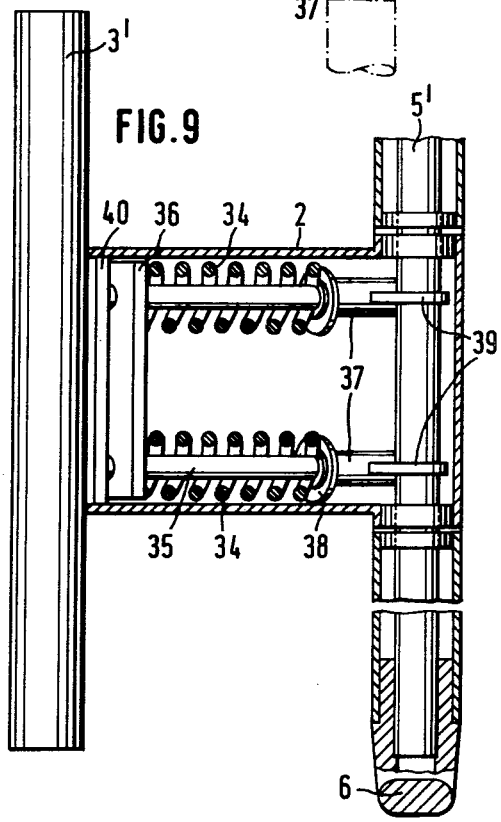
FIG. 9 is a top view of FIG. 8 taken in the direction of the arrow IX.
Figure 10:
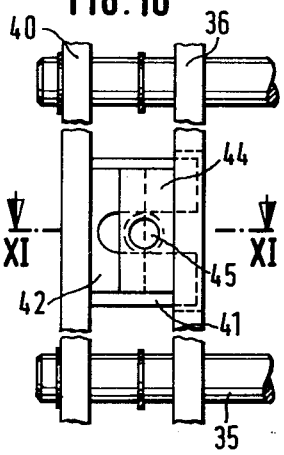
FIG. 10 is a top view of a detail of FIG. 8 taken in the direction of X.
Figure 11:
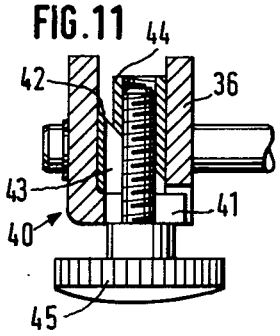
FIG. 11 is a cross sectional view taken along the line XI—XI in FIG. 10.

As shown in FIG. 3, the chair of FIGS. 1 and 2 may be further developed into an arm chair by providing, for example, elastically rebounding or resetting arm rests 19 attached in a zone of the points of articulation 3 and 8 to the seat portion 4 and back portion 7, respectively.

Figure 4:
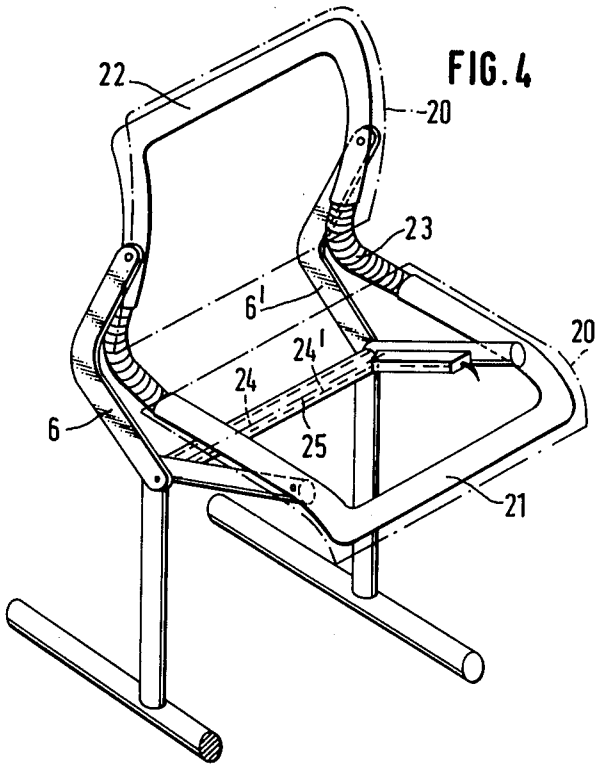
FIG. 4 is a somewhat schematic simplified perspective view of a third embodiment of a piece of sitting furniture in accordance with the present invention.

It is also possible in accordance with the present invention, as shown most clearly in FIG. 4, to provide a chair with padding or upholstery 20 indicated in phantom lines with the seat portion and back portion each being formed by approximately U-shaped tubular supporting frames 21, 22. Bent spring steel members 23 may be interposed or inserted with their ends respectively into the open ends of the supporting tube frames 21, 22, with the bent spring steel members 23 constituting the flexurally elastic zone analogously to the intermediate section 9 in the embodiments of FIGS. 1–3. The bent spring steel members 23 are likewise fashioned so as to be strongly curved in correspondence with the seat shell illustration of FIGS. 5 and 13.

In the embodiment of FIG. 4, the two supporting levers 6, 6' are respectively mounted by a torsion rod 24, 24' in the underframe, with the torsion rods 24, 24' yielding the restoring force. The torsion rods 24, 24' are housed or accommodated in a cross bar 25 to which they are rigidly mounted in a center as shown most clearly in FIG. 6.

The arrangement for fixedly clamping the central ends of the torsion rods 24/24' so as to pretension the same is illustrated in FIG. 6. More particularly, a lever 26 is rigidly joined to the torsion rods 24, 24' and projects into the load bearing arm 2. The level 26 accommodates a knurled screw 27 in a threaded bore arranged at a forward end thereof. The knurled screw 27 rests with its end on a wall of the U-shaped load bearing arm 2. By turning the knurled screw 27, the lever 26 is pivoted about the center of the torsion rods so that the torsion rods 24/24' are turned into a pretensioned position.

Preferrably, restoring springs in the form of cylindrical coil springs or in the form of a pack of leaf springs, arranged within the load bearing arm 2, are provided for the articles of sitting furniture constructed in accordance with the embodiments of FIGS. 1–3. For example, as shown in FIG. 7, with the restoring spring fashioned as a pack of leaf springs 28, the desired restoring force may likewise be adjusted. The leaf pack 28 is disposed at one end between an L-shaped mounting means 29 arranged at the load bearing arm 2 and an abutment 30 threaded to the load bearing arm 2. A free end of the leaf spring pack 28 rests on a bottom end of a cap screw 31 penetrating a cam 32. The cam is connected for rotation with the horizontal shaft 5' by way of a clamping ring 33. By turning the screw 31 inwardly, the leaf spring pack 28 is bent about its abutment 30 and is thus subjected to a pretensioning.

In the restoring force arrangement of FIGS. 8–11, the resetting or restoring force is exerted on the back portion 7 by two coil springs 34 arranged in a parallel side-by-side relationship. The coil springs 34 surround pins 35 which have a first end which penetrates or extends through a movable stop plate 36 forming a supporting surface for the coil springs 34. The second supporting surface for the coil springs 34 is formed by a thrust washer 38 fixedly connected to the pin 35. The pins 35 each are rotatably connected by way of a yoke 37 to a cam 39 on the horizontal shaft 5'.

The pins 35 are supported in corresponding bores of the rigid supporting plate 40 and project, even in a rest position of the chair, beyond the supporting plate 40. The supporting plate 40 carries a bearing member 43 on an L-shaped angle 41. The bearing member 43 is provided with an inclined plane 42. A sliding element 44 rests on the oblique plane and is provided with a threaded bore oriented toward the oblique plane. By means of a knurled-head screw 45, penetrating with relatively great clearance through the L-shaped angle member 41 and bearing member 43 and being threaded into the sliding element 44, the abutment plate 36 may be displaced together with the sliding element 44 and the spring biased of the restoring force arrangement of FIG. 8–11 can thereby be adjusted.

While we have shown and described several embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. A reclinable article of sitting furniture comprising a support means for supporting the article, a seat portion, a back portion, means for mounting a forward area of the seat portion on the support means, and lever means for mounting the back portion on the support means, the lever means has a first end articulated to the back portion and a second end articulated to the support means, characterized in that an arcuate flexible intermediate means is interposed between the seat portion and the back portion connecting the seat and back portions together, the flexible intermediate means is adapted to be flexed such that the arc becomes wider when the intermediate means is flexed, the first end of the lever means is articulated to the back portion at approximately hip level of a user of the article, the second end of the lever means is articulated to the support means at a point below and approximately at a center of the seat portion, and in that a line connecting the points of articulation of the lever means to the back portion and support means subtends, with respect to a vertical plane, a predetermined angle in the range of between 0° and 25° when the article is in a basic upright position.

2. An article according to claim 1, characterized in that the means for mounting the seat portion is a pivot joint means.

3. An article according to claim 2, characterized in that the predetermined angle is in the range of between 15° and 25°.

4. An article according to one of claims 2 or 3, characterized in that, in a vertical longitudinal section, the back portion is curved convexly toward the seat portion, and in that a lower half of the back portion is inclined forwardly in the basic upright position of the article.

5. An article according to claim 4, characterized in that a distance between the points of articulation of the first and second ends of the lever means is about twice as large as a distance between the point of articulation of the second end of the lever means and the mounting point of the forward area of the seat portion to the support means.

6. An article according to claim 5, characterized in that the points of articulation of the lever means and mounting point in a basic position of the article are arranged such that a line connecting the points define an acute triangle.

7. An article according to claim 6, characterized in that the mounting point is disposed rearwardly of a forward edge of the seat portion by a distance equal to about one quarter of depth of the seat portion, and in that about one-third of a forward part of the seat portion is bent downwardly to a greater extent than the forward edge is pivoted upwardly during a rearward swinging of the seat portion.

8. An article according to claim 7, characterized in that the articulation point of the second end of the lever means is offset toward a rear of a center of the seat portion.

9. An article according to claim 8, characterized in that the offset is approximately ten percent of the depth of the seat portion.

10. An article according to claim 8, characterized in that, in a horizontal section, the back portion is curved concavely with respect to the seat portion, means are provided in the back portion for supporting a small of a back of the user, and in that the point of articulation of the first end of the lever means are disposed at the back supporting means.

11. An article according to claim 10, characterized in that the back supporting means is a forwardly curved bulge provided in the back portion.

12. An article according to claim 10, characterized in that the seat portion, back portion, and intermediate means are formed as a one piece shell.

13. An article according to claim 12, characterized in that the shell is formed of a synthetic resin.

14. An article according to claim 12, characterized in that the pivot joint means includes semicylindrical bearings having a snap rim moulded to the shell in the forward area of the seat portion, and a horizontally extending bearing axle means mounted on the support means and accommodated in the bearings.

15. An article according to claim 12, characterized in that means are connected to the pivot joint means and to a point of articulation of the first end of the lever means for providing a force for enabling a restoring of the article from a reclined position to the basic upright position.

16. An article according to claim 15, characterized in that the force providing means includes a pair of elastic arm rests disposed on respective sides of the seat portion.

17. An article according to claim 10, characterized in that the seat portion and back portion each include a separate supporting frame, and in that the intermediate means includes elastic connecting members for connecting respective lateral sides of the support frames to each other.

18. An article according to claim 17, characterized in that means are at least one of directly and indirectly connected to the lever means for providing a force for enabling a restoring of the article from the reclined position to the basic upright position.

19. An article according to claim 18, characterized in that the force providing means is a restoring spring means.

20. An article according to claim 19, characterized in that means are provided for adjusting the force providing means.

21. An article according to claim 20, characterized in that means are provided for locking the lever means in a basic upright position.

22. An article according to claim 21, characterized in that the restoring spring means is a torsion rod means for forming the articulation point of the second end of the lever means, and in that cam means are provided for pretensioning the torsion rod means.

23. An article according to claim 21, characterized in that the restoring spring means includes at least one coil spring, and in that cam means are provided for pretensioning the at least one coil spring means.

24. An article according to claim 21, characterized in that the restoring spring means includes at least one leaf spring, and in that cam means are provided for pretensioning the at least one leaf spring.

25. An article according to claim 21, characterized in that the restoring spring means is a pneumatic spring, and in that cam means are provided for pretensioning the pneumatic spring means.

26. An article according to one of claims 1, 2, or 3, characterized in that the seat portion and back portion each include a separate supporting frame, and in that the intermediate means includes elastic connecting members for connecting respective lateral sides of the supporting frames to each other.

27. An article according to claim 26, characterized in that means are connected to the supporting lever means for providing a force for enabling a restoring of the article from a reclined position to the basic upright position.

28. An article according to claim 27, characterized in that the force providing means is a restoring spring means.

29. An article according to claim 28, characterized in that means are provided for locking the lever means in a basic upright position.

30. An article according to one of claims 1, 2, or 3, characterized in that means are connected to the supporting lever means for providing a force for enabling a restoring of the article from a reclined position to the basic upright position.

31. An article according to one of claims 1, 2, or 3, characterized in that, in a horizontal section, the back portion is curved concavely with respect to the seat portion, means are provided in the back portion for supporting a small of a back of the user, and in that the point of articulation of the first end of the lever means are disposed at the back supporting means.

32. An article according to claim 31, characterized in that the seat portion, back portion and intermediate means are formed as a one piece shell.

* * * * *

UNITED STATES PATENT AND TRADEMARK OFFICE

CERTIFICATE OF CORRECTION

PATENT NO. : 4,451,085

DATED : May 29, 1984

INVENTOR(S) : Klaus Franck and Werner Sauer

It is certified that error appears in the above-identified patent and that said Letters Patent is hereby corrected as shown below:

Assignee: Wilkhahn Wilkening + Hahne GmbH + Co.

Signed and Sealed this

*Twenty-second* Day of *April 1986*

[SEAL]

*Attest:*

DONALD J. QUIGG

*Attesting Officer*

*Commissioner of Patents and Trademarks*